US006780034B2

(12) United States Patent
Shiroshita et al.

(10) Patent No.: US 6,780,034 B2
(45) Date of Patent: Aug. 24, 2004

(54) COALESCENT TYPE POWER SUPPLY CONVERSION PLUG ADAPTER

(75) Inventors: Tohru Shiroshita, Ueda (JP); Hiroyuki Hiraide, Ueda (JP)

(73) Assignee: Shiroshita Industrial Co., Ltd., Ueda (JP)

( * ) Notice: Subject to any disclaimer, the term of this patent is extended or adjusted under 35 U.S.C. 154(b) by 51 days.

(21) Appl. No.: 10/298,617

(22) Filed: Nov. 19, 2002

(65) Prior Publication Data

US 2004/0097114 A1 May 20, 2004

(51) Int. Cl.[7] ..... H01R 29/00
(52) U.S. Cl. ..... 439/174
(58) Field of Search ..... 439/166, 170, 439/171, 173, 174, 175

(56) References Cited

U.S. PATENT DOCUMENTS 3,120,985 A * 2/1964 Hubbell ..... 439/166
4,856,999 A * 8/1989 Flohr ..... 439/52
4,904,195 A * 2/1990 Thackeray ..... 439/173
5,885,109 A * 3/1999 Lee et al. ..... 439/652
5,938,459 A * 8/1999 Lee et al. ..... 439/172
6,010,347 A * 1/2000 Lee ..... 439/222
6,220,880 B1 * 4/2001 Lee et al. ..... 439/214
6,320,717 B1 * 11/2001 Feng ..... 360/75
6,328,581 B1 * 12/2001 Lee et al. ..... 439/106
6,330,144 B1 * 12/2001 Lee et al. ..... 361/115
6,520,787 B1 * 2/2003 Lott ..... 439/218

* cited by examiner

*Primary Examiner*—Tulsidas C. Patel
(74) *Attorney, Agent, or Firm*—Kanesaka & Takeuchi

(57) ABSTRACT

A coalescent type power supply conversion plug is capable of connecting to different power supply plug sockets. The plug includes a first adapter having two round bar-shaped plug terminals so that a pitch width of plug terminals is adjustable. A pin for earth hole for B type, C type and SE type is foldably provided in the center portion of the plug terminals, and a plug-in port connectable to the sockets of all the types is provided in the rear end surface. Another pin for flat plate-shaped hole for BF type and a pin for round bar shaped earth hole for B3 type is foldably provided in a second adapter. Flat plate-shaped plug terminals and a pin for earth hole are provided in the plug terminals. A plug-in port connectable to the sockets of all kinds is provided in the rear end surface.

5 Claims, 8 Drawing Sheets

COALESCENT TYPE POWER SUPPLY CONVERSION PLUG ADAPTER

BACKGROUND OF THE INVENTION

1. Field of the Invention

The present invention relates to a coalescent type power supply conversion plug adapter, which corresponds to the power supply plug sockets of many countries of the world, such as Argentina, Australia, Austria, Canada, China, England, France, Germany, Hong Kong, India, Indonesia, Iran, Italy, Jamaica, Japan, New Zealand, Singapore, Switzerland, U.S.A. And so on.

2. Description of the Related Art

The power supply plug sockets of many countries of the world have a broad range of types, so called BF, B3, B, C, SE, O, O2, and A. For example, in case of traveling abroad, when a traveler uses the electric appliances of his own country, he needs various types of plug adapters, which adapt to the socket of each country.

Now, the conventional plug adapters have been required to be used with number of types which corresponds to each socket type, and the size of a single adapter is very large so as to be extremely lacking in portability.

Also, in the case where the respective adapters corresponding to each socket type are singly used, particularly in case of the type which uses a pin for earth hole, there have been found a lot of adapters which lack a stability in being plugged into the socket.

SUMMARY OF THE INVENTION

The present invention has been carried out in view of the above-described problem, and it is an object of the invention to provide a coalescent type power supply conversion plug adapter, which has a good portability even for travels abroad by keeping the number of required adapters to a minimum and making them compact, and stabilizes the plugging of the adapter into the socket.

The present invention has been carried out in order to achieve the above-described object, and in the coalescent type power supply conversion plug adapter, a first adapter (1) has two round bar-shaped plug terminals (A) projectingly provided on its upper end surface portion, which are movable in parallel in a state of being projectingly provided so that a pitch width of the plug terminals (A) is adjustable, and a pin (A2) for earth hole for B type, C type and SE type is foldably provided in the center portion of the plug terminals (A), and a plug-in port (1Z) connectable to the sockets of many countries of the world is provided in the rear end surface, and a pin (B) for a flat plate-shaped earth hole for BF type and a pin (C) for a round bar shaped earth hole for B3 type are foldably provided in a second adapter (2) on its opposed side surface, and flat plate-shaped plug terminals (D) projectingly provided on the upper end surface are movably provided so as to correspond to the pins for A type and O type, and a pin (D2) for earth hole for A type and a pin (D3) for earth hole for O2 type are foldably provided in the center portion of the plug terminals (D), and a plug-in port (2Z) connectable to the sockets of many countries of the world is provided in the rear end surface, and the first adapter (1) and the second adapter (2) can be coalesced in each mode according to use-applications.

Since the present invention is configured as described above, it is possible to coalesce the first adapter and the second adapter and use each socket type of BF type and B3 type depending on the mode of the coalesced state, and correspond to the sockets of many countries of the world by singly using the first adapter or the second adapter.

Also, since the pin for earth hole provided on the second adapter can be folded down, the portability becomes extremely good in a state of the first adapter and the second adapter being coalesced.

Also, in the case where the invention is used for BF type and B3 type, since the first adapter and the second adapter are used in a state of being coalesced, a contact area between a wall surface in which the power source hole is provided and the adapter is increased so that it is possible to eliminate shakiness and stabilize the plug-in operation.

Also, it is possible to adjust the pitch width of the plug terminals of the first adapter and adequately correspond to the power source holes of many countries of the world.

Note that BF type means a power source socket used in the countries such as Argentina, England, Singapore, Hong Kong and the like, and specifically comprises a combination of two round bar shaped-plug terminals and a flat plate shaped pin for earth hole.

B3 type means a power source socket used in the countries such as Iran, India, Indonesia, Jamaica and the like, and specifically comprises a combination of two round bar-shaped plug terminals and a round bar shaped pin for earth hole.

B, C, SE types mean power source sockets used in the countries such as Italy, Austria, Germany, France, Switzerland and the like, and specifically comprise two round bar-shaped plug terminals or two round bar-shaped plug terminals and the round bar shaped pin for earth hole, where the pitch width of the plug terminals is different depending on the countries.

O type means a power source socket used in the countries such as Australia, New Zealand and the like, and specifically, the flat plate-shaped plug terminals are configured in the shape of inverted V bottom.

O2 type means a power source socket used in China, and specifically, the flat plate-shaped terminals have the shape of inverted V bottom, and comprise a combination with a flat plate shaped pin for earth hole.

A type means power source socket used in United States, Canada, Japan and the like, and comprises the flat plate-shaped plug terminals, and there is available in America and the like a combination with the round bar shaped pin for earth bole.

DESCRIPTION OF THE PREFERRED EMBODIMENT

An embodiment of the present invention will be described below based on the accompanying drawings.

The present invention comprises a first adapter (1) and a second adapter (2), which become a power source conversion plug adapter capable of corresponding to socket types of many the countries, that is, various types such as BF, B3, B, C, SE, O, O2, and A depending on the mode of the combination thereof.

The first adapter (1) has plug terminals (A) which are projectingly provided on the upper end surface of a substrate comprising an insulator.

Specifically, for example, the lower ends of the plug terminals (A) formed in the shape of a round bar are buried in the first adapter (1), and the round bar plug terminals (A) are protruded.

Since the plug terminals (A) can move in parallel in a state of being projectingly provided, it is possible to adjust a pitch width of the plug terminals (A).

Note that a movable structure of the plug terminals (A) is configured such that a slide member connected to the plug terminals (A) is provided, for example, inside the first adapter (1) and such a slide member is protruded from the side surface portion of a substrate.

By adopting such a structure, it is possible to use the power source conversion plug adapter according to the present invention by corresponding to various pitch widths of the power source terminal holes of many countries.

Also, a round bar shaped pin for earth hole (A2) is foldably provided in the center portion of the plug terminals (A) of the first adapter (1). In this way, by combining with the plug terminals (A), it is possible for the first adapter (1) to correspond to the types using the earth holes of B type, C type and SE type.

Figure 9:
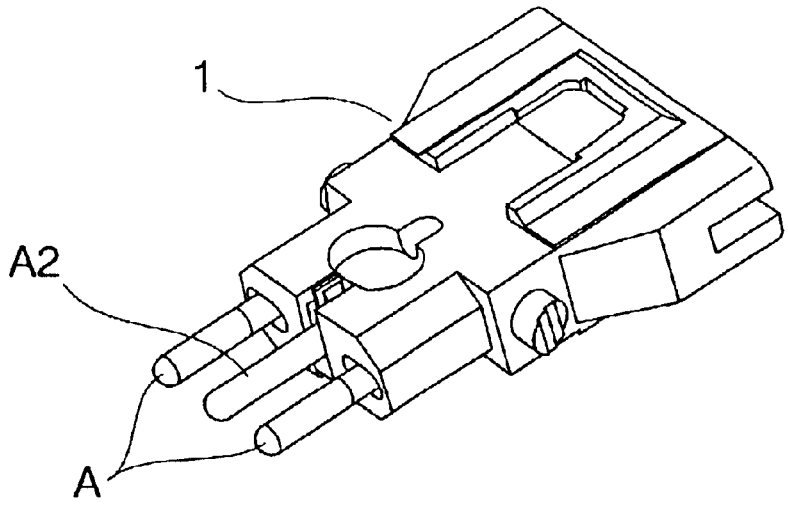
FIG. 9 is a perspective view showing one embodiment of the first adapter in the coalescent type power supply conversion plug adapter according to the present invention, and is a perspective view showing the example of how B, C and SE type sockets are used.
Figure 10:
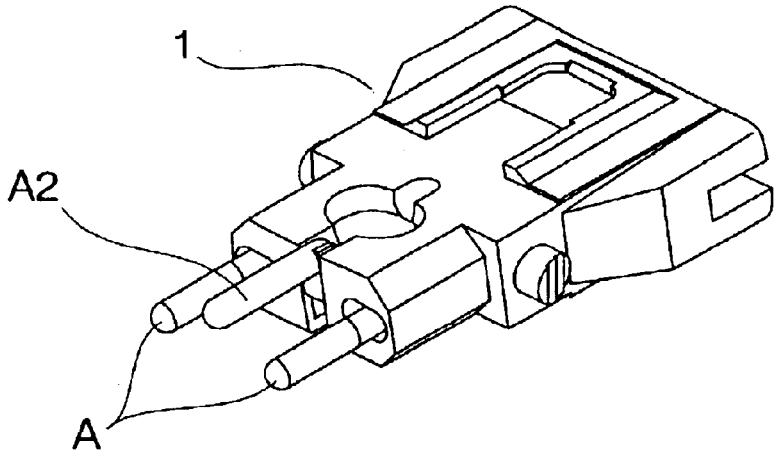
FIG. 10 is a perspective view showing one embodiment of the first adapter in the coalescent type power supply conversion plug adapter according to the present invention, and is a perspective view showing the example of how B, C and SE type sockets are used.
Figure 11:
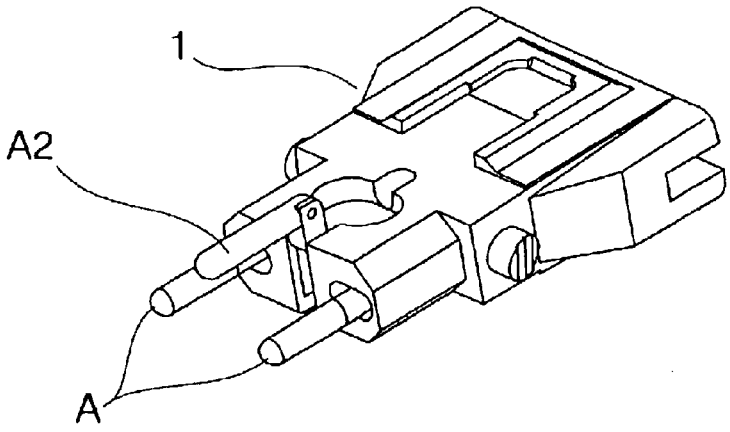
FIG. 11 is a perspective view showing one embodiment of the first adapter in the coalescent type power supply conversion plug adapter according to the present invention, and is a perspective view showing the example of how B, C and SE type sockets are used.
Figure 12:
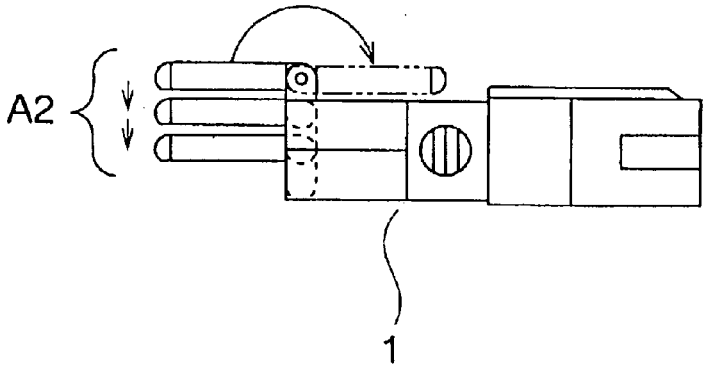
FIG. 12 is a side view showing one embodiment of the first adapter in the coalescent type power supply conversion plug adapter according to the present invention.

Note that, since the arrangement of the pins for earth hole becomes different due to the relation with the plug terminals, possible to provide the round bar shaped pin for earth hole (A2) which is adjusted to the upper direction against the plug terminals as illustrated in (FIG. 9, FIG. 10, FIG. 11).

A pin (B) for earth hole for BF type and a pin (C) for earth hole for B3 type are provided in the opposing side surfaces of the insulating substrate of the second plug (2).

The present invention combines the first adapter (1) and the second adapter (2) so that it can be used for the sockets of these BF type and B3 type.

Figure 6:
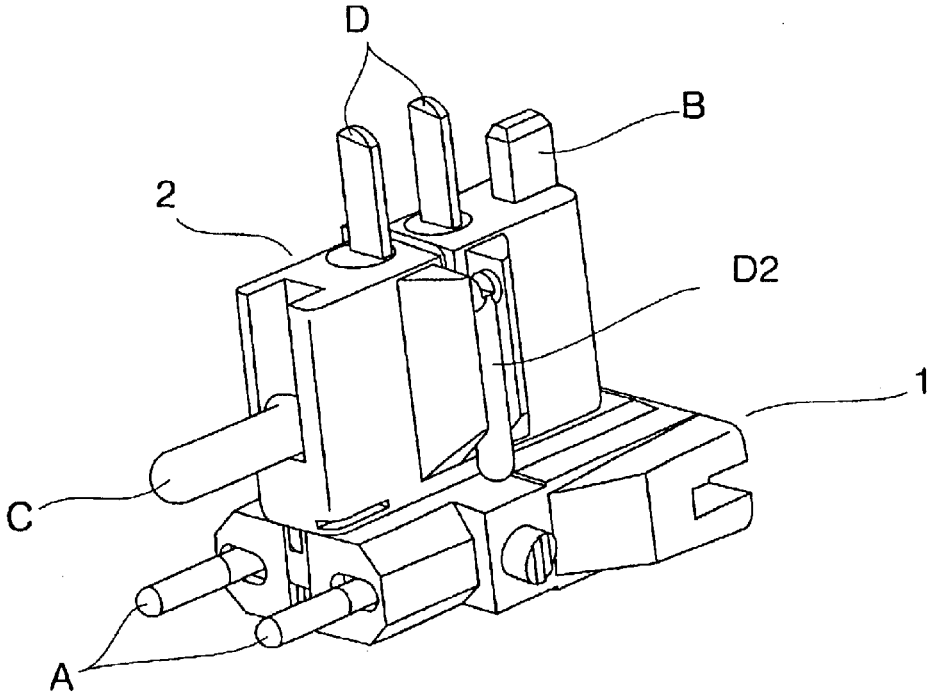
FIG. 6 is a perspective view showing one embodiment of the coalescent type power supply conversion plug adapter according to the present invention, and is a perspective view showing an example of how a B3 type socket is used.
Figure 7:
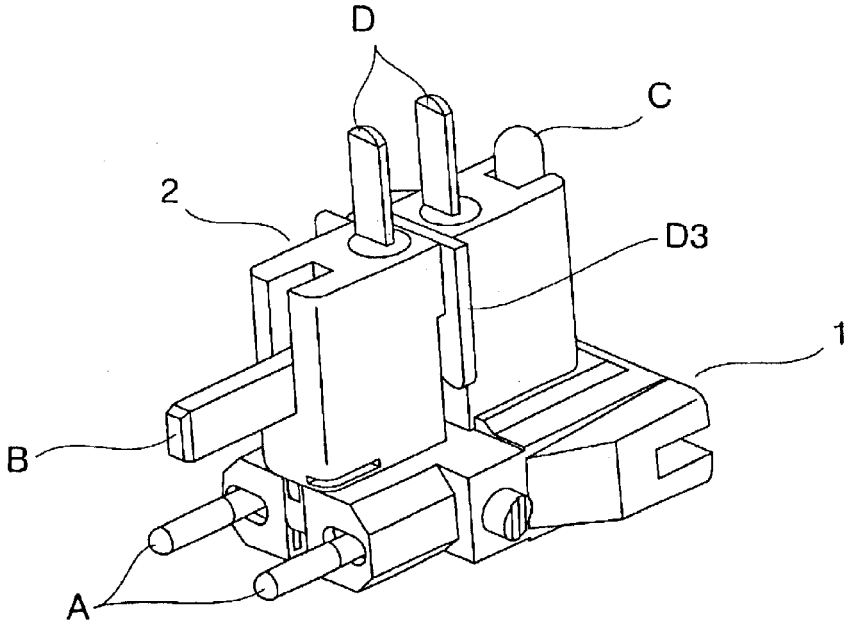
FIG. 7 is a perspective view showing one embodiment of the coalescent type power supply conversion plug adapter according to the present invention, and is a perspective view showing the example of how a BF type socket is used.

For example, as illustrated in FIG. 6 and FIG. 7, in a state of each pin for earth hole (B, C) being protruded in the same direction to the plug terminals (A) which are projectingly provided on the first adapter (1), the first adapter (1) and the second adapter (2) are coalesced so that they can be used for the sockets of BF type and B3 type.

Note that, since the pin (B) for earth hole for BF type and the pin (C) for earth hole for B3 type which are provided on the second adapter (2) can be folded down, each pin for earth hole is to be folded down when it is used for the sockets of B type and C type.

A structure which can be folded down is such that, for example, the rear end portion of each pin for earth hole (B, C) buried inside the second adapter (2) becomes a rotational axis, and is rotated in both directions so as to be locked in a state vertically provided against the substrate side surfaces and in a state of being stored in parallel inside the substrate against the substrate side surfaces.

In a state of the first adapter (1) and the second adapter (2) being coalesced, they are plugged into the socket, therefore the second adapter (2) adheres to the wall surface provided in a socket hole, and highly stabilized plug-in is realized.

Figure 1:
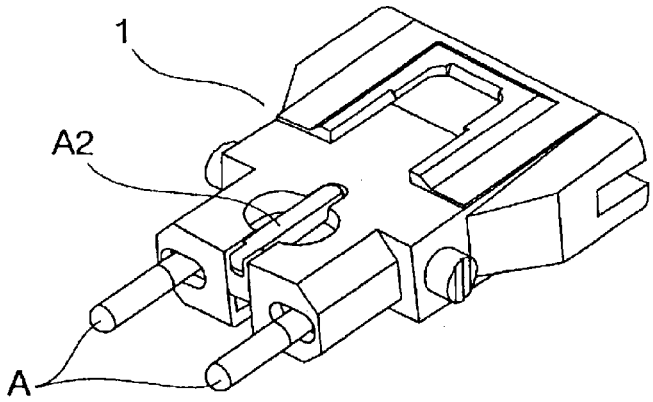
FIG. 1 is a perspective view showing one embodiment of a first adapter in a coalescent type power supply conversion plug adapter according to the present invention.
Figure 2:
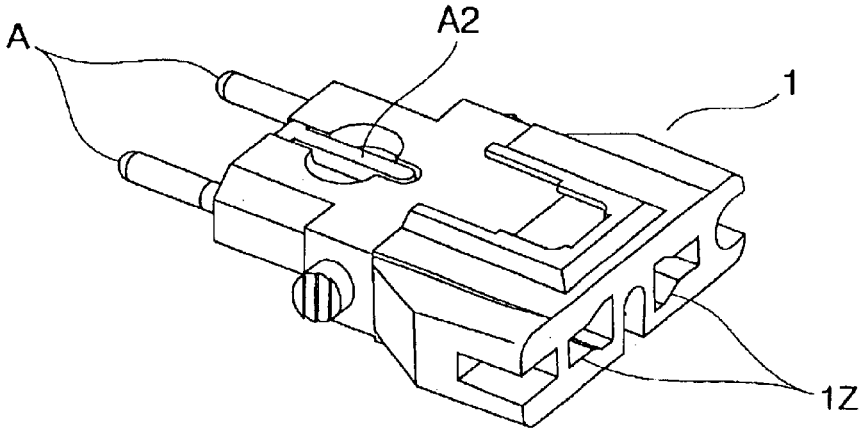
FIG. 2 is a perspective view showing one embodiment of the first adapter in the coalescent type power supply conversion plug adapter according to the present invention.
Figure 3:
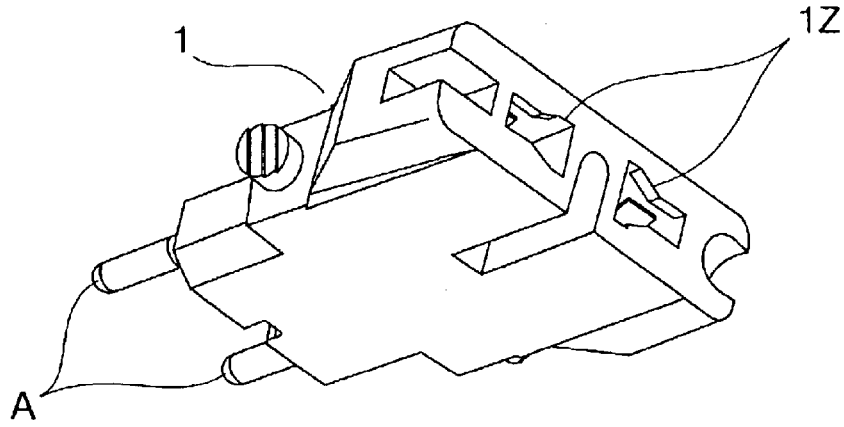
FIG. 3 is a perspective view showing one embodiment of the first adapter in the coalescent type power supply conversion plug adapter according to the present invention.
Figure 4:
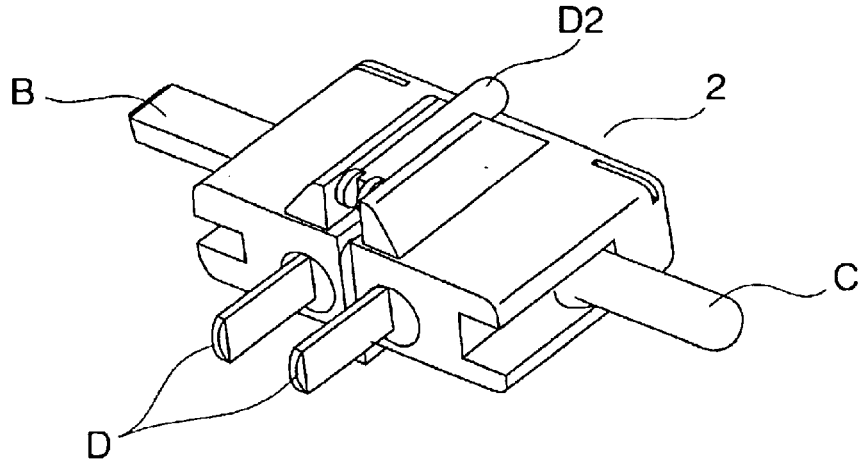
FIG. 4 is a perspective view showing one embodiment of a second adapter in the coalescent type power supply conversion plug adapter according to the present invention.
Figure 5:
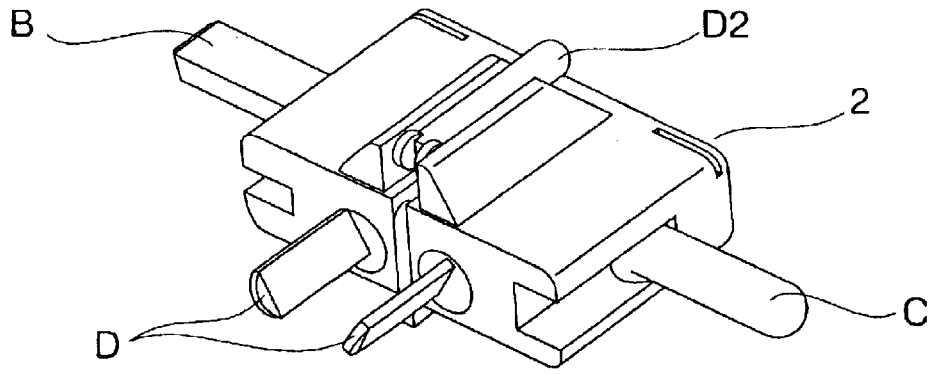
FIG. 5 is a perspective view showing one embodiment of the second adapter in the coalescent type power supply conversion plug adapter according to the present invention.

Note that the first adapter (1) is to be singly used in the sockets of B type, C type and SE type (see FIG. 1, FIG. 10 and the like), and the second adapter (2) is to be singly used in the sockets of O type and A type (see FIG. 13, FIG. 14 and the like), respectively.

Figure 8:
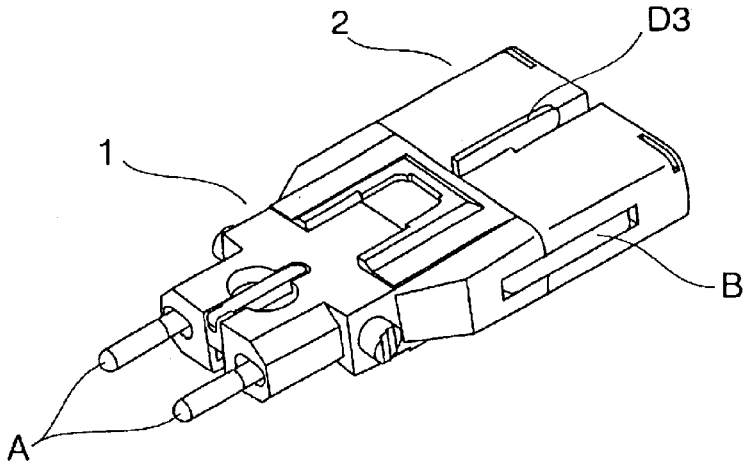
FIG. 8 is a perspective view showing one embodiment of the coalescent type power supply conversion plug adapter according to the present invention, and is a perspective view showing a state when the plug adapter is stored.

Further, in the present invention, the flat plate-shaped plug terminals (D) for O type and A type are projectingly provided on the front end surface of the second adapter (2) and can be plugged into the plug-in port (1Z) of the rear end surface of the first adapter (1), and each pin for earth hole (B, C) of the second adapter (2) is folded down so that an adapter for overseas use having high compactness and portability can be provided as illustrated in FIG. 8.

Note that, in order to store each pin for earth hole (B, C) of the second adapter (2) which is folded down, a groove to store the pin for earth hole is, for example, provided on both side surfaces of the first adapter (1) so that the side surfaces of the two adapters become flat in a coalesced state, thereby achieving a structure to enhance the portability.

Also, the present invention has the second adapter (2) provided with a pin (D2) for earth hole for A type and a pin (D3) for earth hole for O2 type.

Figure 13:
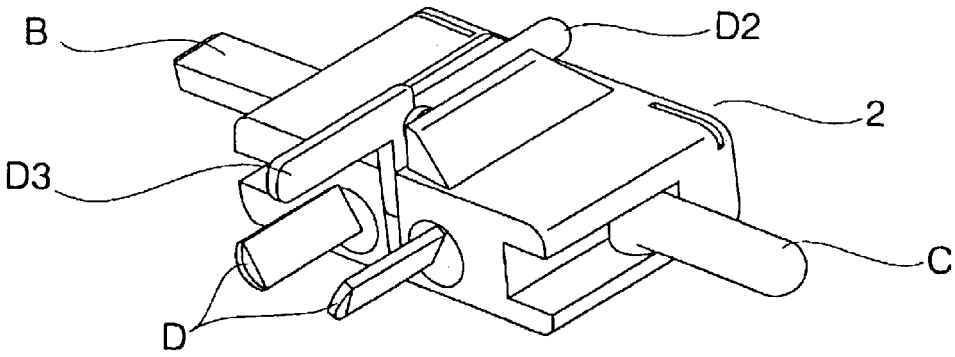
FIG. 13 is a perspective view showing one embodiment of the second adapter in the coalescent type power supply conversion plug adapter according to the present invention, and is a perspective view showing the example of how O2 type socket is used.
Figure 14:
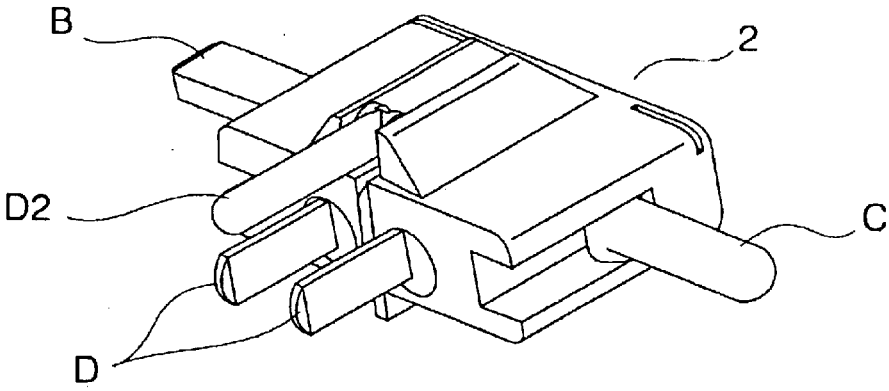
FIG. 14 is a perspective view showing one embodiment of the second adapter in the coalescent type power supply conversion plug adapter according to the present invention, and is a perspective view showing the example of how A type socket is used.
Figure 15:
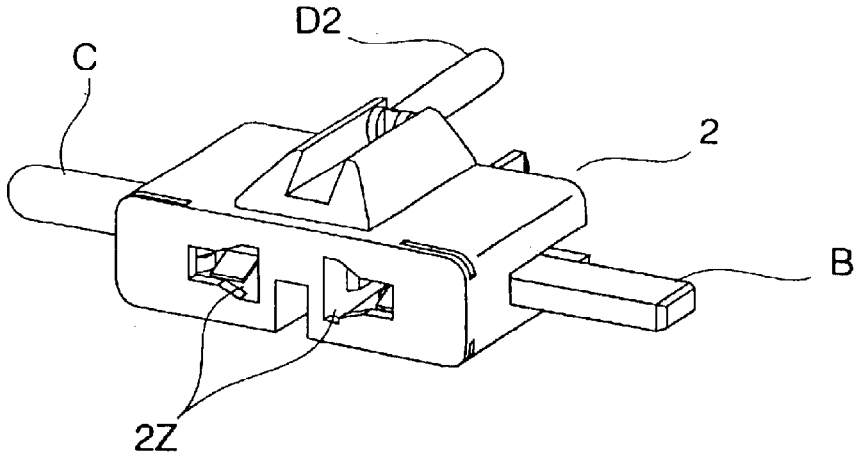
FIG. 15 is a side view showing one embodiment of the second adapter in the coalescent type power supply conversion plug adapter according to the present invention.
Figure 16:
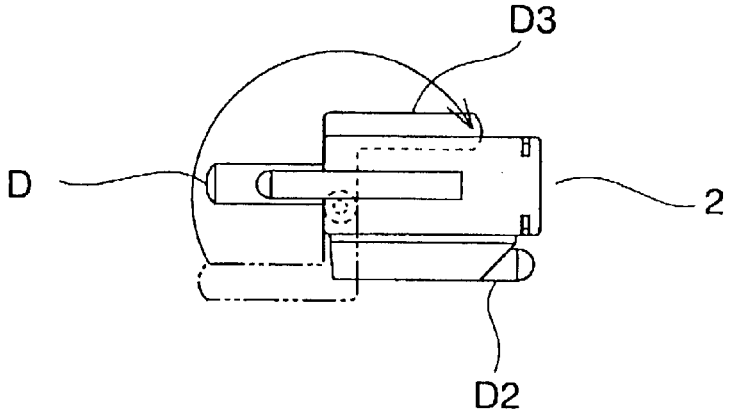
FIG. 16 is a perspective view showing one embodiment of the second adapter in the coalescent type power supply conversion plug adapter according to the present invention.

In order to make it possible to insert the pins for earth hole (D2, D3) into a socket with an earth shutter, they are provided in such a manner as to be positioned in the central portion between the flat plate-shaped plug terminals (D) for O type and A type , for example, as illustrated in the drawings (FIG. 13 and FIG. 14).

Note that conceivable is a structure and the like in which the pins for earth hole (D2, D3) are foldably provided, and are protruded only when in use and can be stored inside the substrate when not in use.

Also, the pin (D3) for earth hole for O2 type is to be rotated in the direction of the opposed side surface when in use.

The flat plate-shaped plug terminals provided on the second adapter are movably configured so as to correspond to both types of O type and A type.

Note that since both the first adapter (1) and the second adapter (2) have the plug-in ports connectable to the sockets of many countries of the world in the rear end surface, they are connectable to various types of sockets under many use conditions.

By adopting such a configuration as described above, the present invention has the following effects.

Since the present invention is configured as described above, the first adapter and the second adapter can be coalesced and used for each socket of BF type and B3 type depending on the mode of coalescing.

Also, since the pin for earth hole provided on the second adapter can be folded down, the invention can be used for each socket of B type and C type in a state of the first adapter and the second adapter being coalesced.

In the case where the invention is used for the sockets of BF type and B3 type, since the first adapter and the second adapter are used in a state of being coalesced, the contact area between the wall surface in which the power supply hole is provided and the adapter is increased so that it is possible to eliminate shakiness and stabilize the plug-in operation.

Also, it is possible to adjust the pitch width of the plug terminals of the first adapter and adequately correspond to the power supply holes of many countries of the world.

What is claimed is:

1. A coalescent type power supply conversion plug adapter capable of corresponding to power supply plug sockets in different countries, comprising:

a first adapter (1) including a first body having an upper end surface portion and a rear end surface, two round bar-shaped plug terminals (A) projecting from the upper end surface portion to be movable in parallel in a state of being projected so that a distance of the plug terminals (A) is adjustable, a pin (A2) for an earth hole foldably provided in a center area of the plug terminals (A), and a plug-in port (1Z) provided in the rear end surface adapted to be connected to sockets of different countries, and a second adapter (2) connectable to the first adapter (1) as required, and including a second body having an upper end surface, a rear end surface and two sides opposite to each other, a pin (B) for a flat plate-shaped hole foldably provided at one of the two sides of the second body, a pin (C) for a round bar shaped earth hole foldably provided at the other of the two sides of the second body, flat plate-shaped plug terminals (D) movably projecting from the upper end surface, a pin (D2) for an earth hole foldably provided in a center portion of the plug terminal (D), a pin (D3) for an earth hole foldably provided in the center portion of the plug terminals (D), and a plug-in port (2Z) provided in the rear end surface to be connectable to the sockets of different countries.

2. A coalescent type power supply conversion plug adapter according to claim 1, wherein said flat plate-shaped terminals (D) and the pin (D2) can project in the same direction to be used together.

3. A coalescent type power supply conversion plug adapter according to claim 1, wherein said pin (D3) and the pin (D2) can project in the same direction to be used together.

4. A coalescent type power supply conversion plug adapter according to claim 1, wherein said plug terminals (A) and the pin (C) can project in the same direction to be used together when the first and second adapters (1) and (2) are assembled.

5. A coalescent type power supply conversion plug adapter according to claim 1, wherein said plug terminals (A) and the pin (B) can project in the same direction to be used together when the first and second adapters (1) and (2) are assembled.

* * * * *